US008678136B1

(12) United States Patent
Hamilton

(10) Patent No.: US 8,678,136 B1
(45) Date of Patent: Mar. 25, 2014

(54) TRAY

(76) Inventor: Lori Hamilton, Morning Sun, IA (US)

( * ) Notice: Subject to any disclaimer, the term of this patent is extended or adjusted under 35 U.S.C. 154(b) by 355 days.

(21) Appl. No.: 12/549,054

(22) Filed: Aug. 27, 2009

Related U.S. Application Data

(60) Provisional application No. 61/190,525, filed on Aug. 30, 2008.

(51) Int. Cl.
*E06C 7/14* (2006.01)

(52) U.S. Cl.
CPC ..... *E06C 7/14* (2013.01)
USPC ..... 182/129; 182/178.1; 182/178.5; 248/210; 248/238

(58) Field of Classification Search
USPC ..... 182/129, 178.1, 178.5, 222, 223; 248/210, 238; 206/372, 373; 108/141
See application file for complete search history.

(56) References Cited

U.S. PATENT DOCUMENTS 1,096,327 A * 5/1914 Thorniley ..... 108/141
1,272,015 A * 7/1918 Davis ..... 108/141
1,283,869 A * 11/1918 Nelson & Espersen ..... 108/141
1,894,991 A * 1/1933 Hayes ..... 108/8
2,222,078 A * 11/1940 Kroeger et al. ..... 182/129
2,446,972 A * 8/1948 Wyen ..... 52/632
2,535,112 A * 12/1950 Woody ..... 312/233
2,798,574 A * 7/1957 Wardell ..... 187/401
3,435,783 A * 4/1969 Kollenborn ..... 108/8
4,418,793 A * 12/1983 Brent ..... 182/129
5,058,911 A * 10/1991 Hunter et al. ..... 280/47.35
5,707,036 A * 1/1998 Dunbar ..... 248/447.2
5,971,512 A * 10/1999 Swan ..... 312/281

* cited by examiner

*Primary Examiner* — Alvin Chin Shue
*Assistant Examiner* — Colleen M Chavchavadze
(74) *Attorney, Agent, or Firm* — Hamilton IP Law, PC; Jay R. Hamilton; Charles A. Damschen

(57) ABSTRACT

A tray is adapted to be attached to a scaffold, which may be achieved either through a clamp or by inserting an element into the end of a scaffold vertical member. A support structure of the tray may be affixed to a support structure, wherein the support structure is configured to provide a surface on which the user may position certain items. The tray has at least two axes of rotation with respect to the structure to which it is mounted, and the tray may be configured to be height adjustable. In one embodiment, the tray is configured specifically to support a paint container, and in another embodiment the tray is configured so that the support structure is formed as a tub.

9 Claims, 6 Drawing Sheets

TRAY

CROSS REFERENCE TO RELATED APPLICATIONS

This application claims the filing benefit under 35 U.S.C. §119(e) of provisional U.S. Patent Application Ser. No. 61/190,525 filed on Aug. 30, 2008, which is incorporated by reference herein in its entirety.

FIELD OF THE INVENTION

The apparatus described herein is generally applicable to the field of object support from an elevated surface. The embodiments shown and described herein are more particularly for a two-axis support tray to attach to scaffold.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. §1.71 (d)

A portion of the disclosure of this patent document contains material which is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

DETAILED DESCRIPTION

DETAILED DESCRIPTION

Listing of Elements

Figure 1:
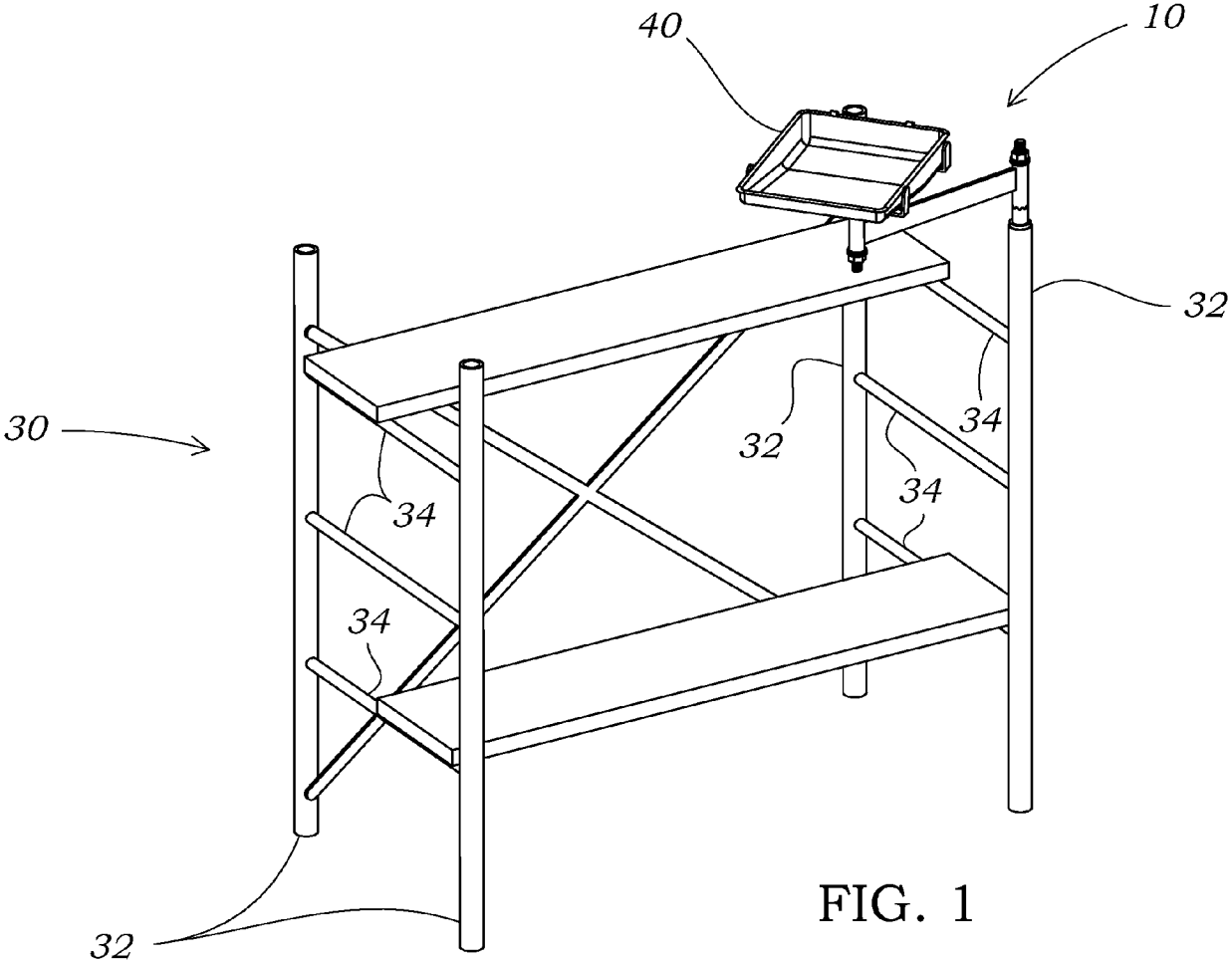
FIG. 1 is a perspective view of one embodiment of the tray installed on scaffolding.

| Element Description | Element Number |
|---|---|
| Tray | 10 |
| End horizontal support | 12a |
| Center horizontal support | 12b |
| Center support first portion | 12c |
| Center support second portion | 12d |
| Vertical support | 14 |
| Retainer hook | 16 |
| Tray post | 18 |
| Tray post top piece | 18a |
| Tray post bottom piece | 18b |
| Tray post cooperating teeth | 18c |
| Arm | 20 |
| Nut | 22 |
| Bolt | 24 |
| Scaffold post | 28 |
| Scaffold post top piece | 28a |
| Scaffold post bottom piece | 28b |
| Scaffold post cooperating teeth | 28c |
| Scaffold stop | 28d |
| Scaffold | 30 |
| Scaffold vertical member | 32 |
| Scaffold horizontal member | 34 |
| Paint container | 40 |
| End wall | 42 |
| Bottom wall | 44 |
| Tub | 50 |

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

DETAILED DESCRIPTION OF INVENTION

Referring now to the drawings, wherein like reference numerals designate identical or corresponding parts throughout the several views, FIG. 1 provides a perspective view of one embodiment of the tray 10 installed on a scaffold 30 during use. Although the various embodiments pictured herein are specifically adapted to be affixed to a scaffold 30, the tray 10 is not so limited. Accordingly, in other embodiments of the tray 10, the tray is affixed to a different support structure, such as a ladder (not shown).

Figure 4:
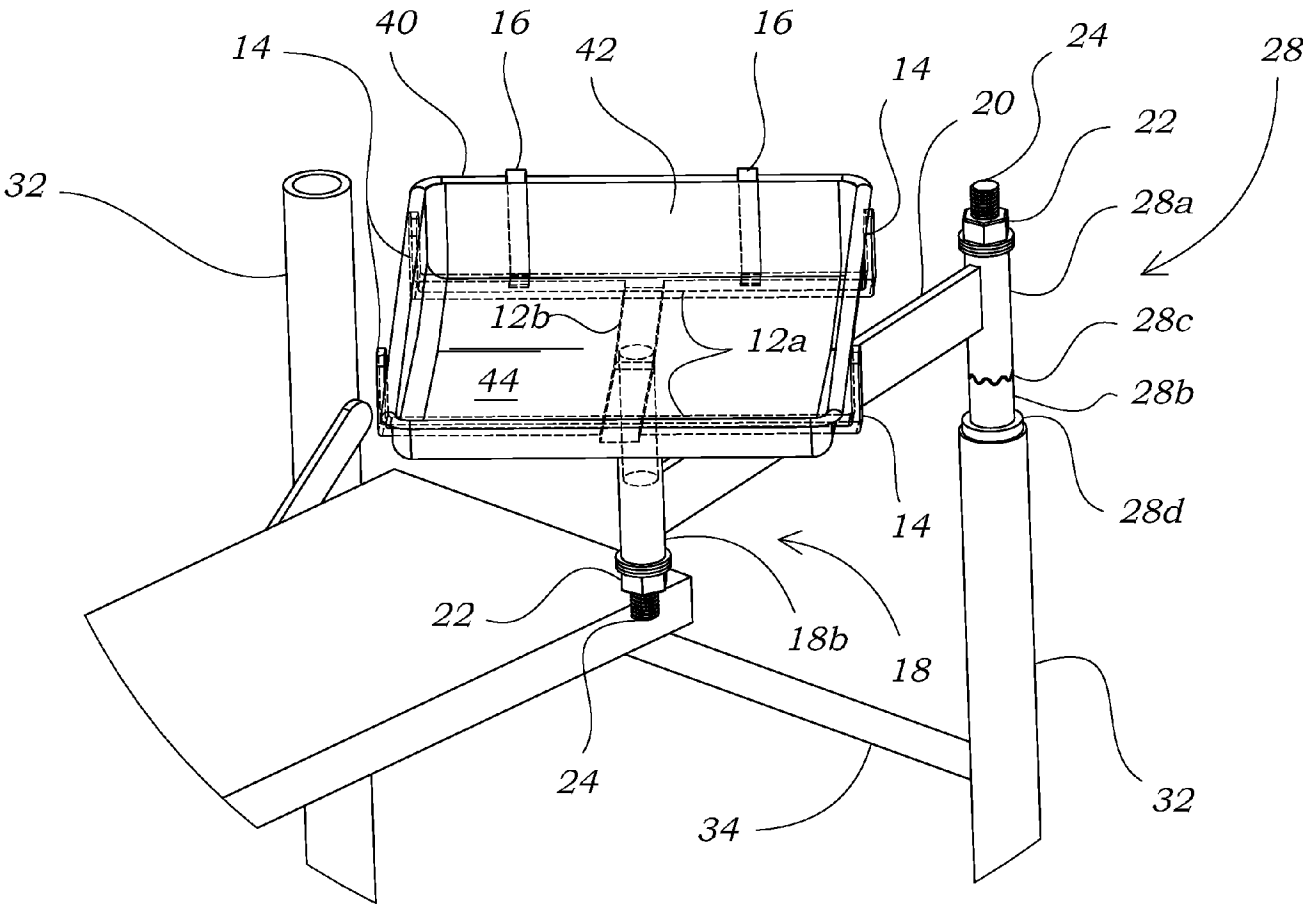
FIG. 4 is a detailed view of one embodiment of the tray engaged with a paint container.

The tray 10 in the embodiments pictured herein interfaces with the scaffold 30 through the scaffold post 28. A portion of the scaffold post 28 is fashioned so that it may be inserted into the hollow end of one of the scaffold vertical members 32, which is best shown in FIG. 4 and described in further detail below. The tray 10 may use other structures to engage the scaffold 30. For example, a clamp (not shown) may be used to engage a portion of the scaffold vertical member 32 or the scaffold horizontal member 34, as is well known to those skilled in the art. Similarly, magnets (not shown) may be used to affix the tray 10 to a scaffold 30 with a variety of different types of metal frames. Accordingly, any structure known to those skilled in the art sufficient to support the weight of the tray 10 and its contents for a particular application may be used without departing from the spirit and scope of the tray 10 as disclosed herein.

Figure 2:
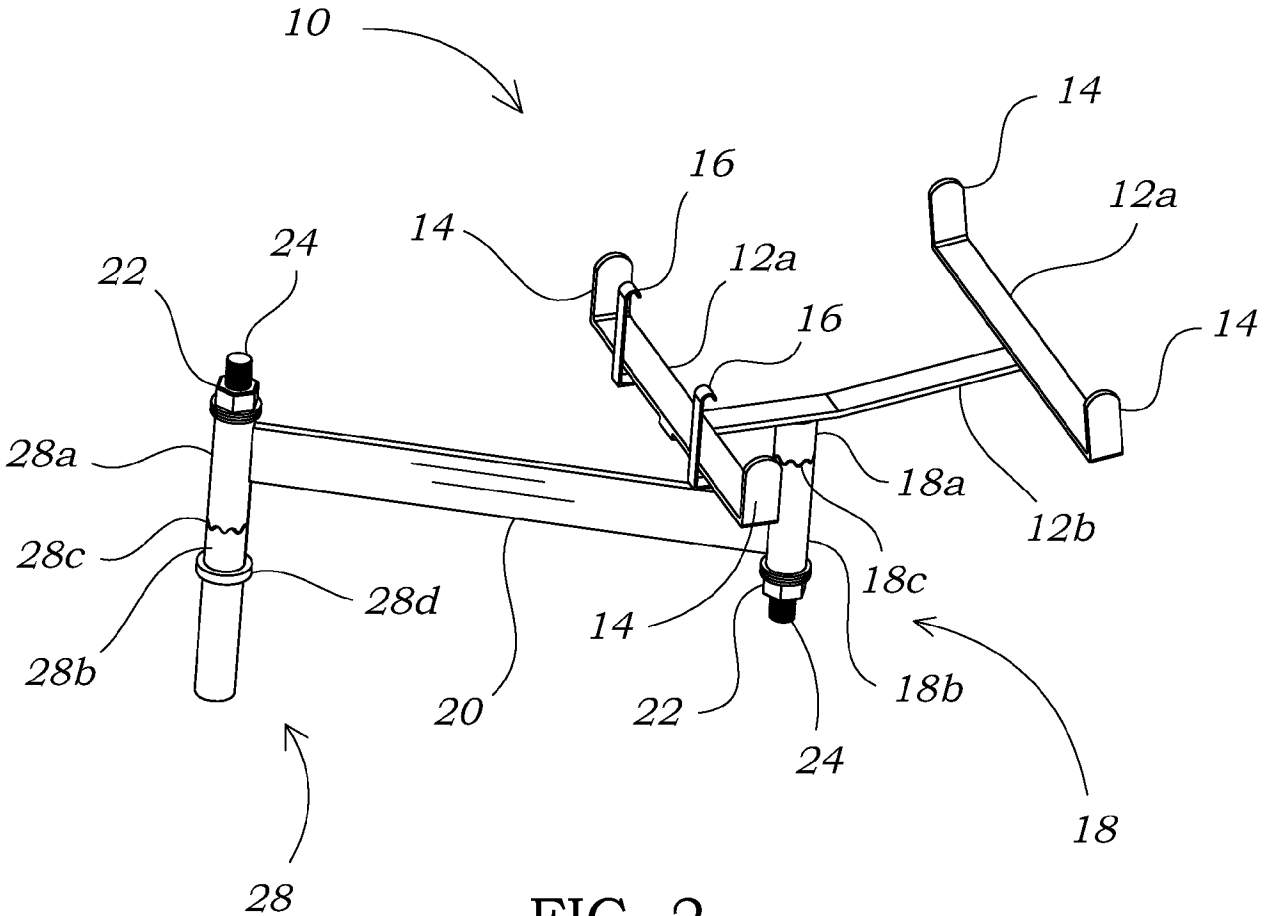
FIG. 2 is a top perspective view of one embodiment of the tray.
Figure 3:
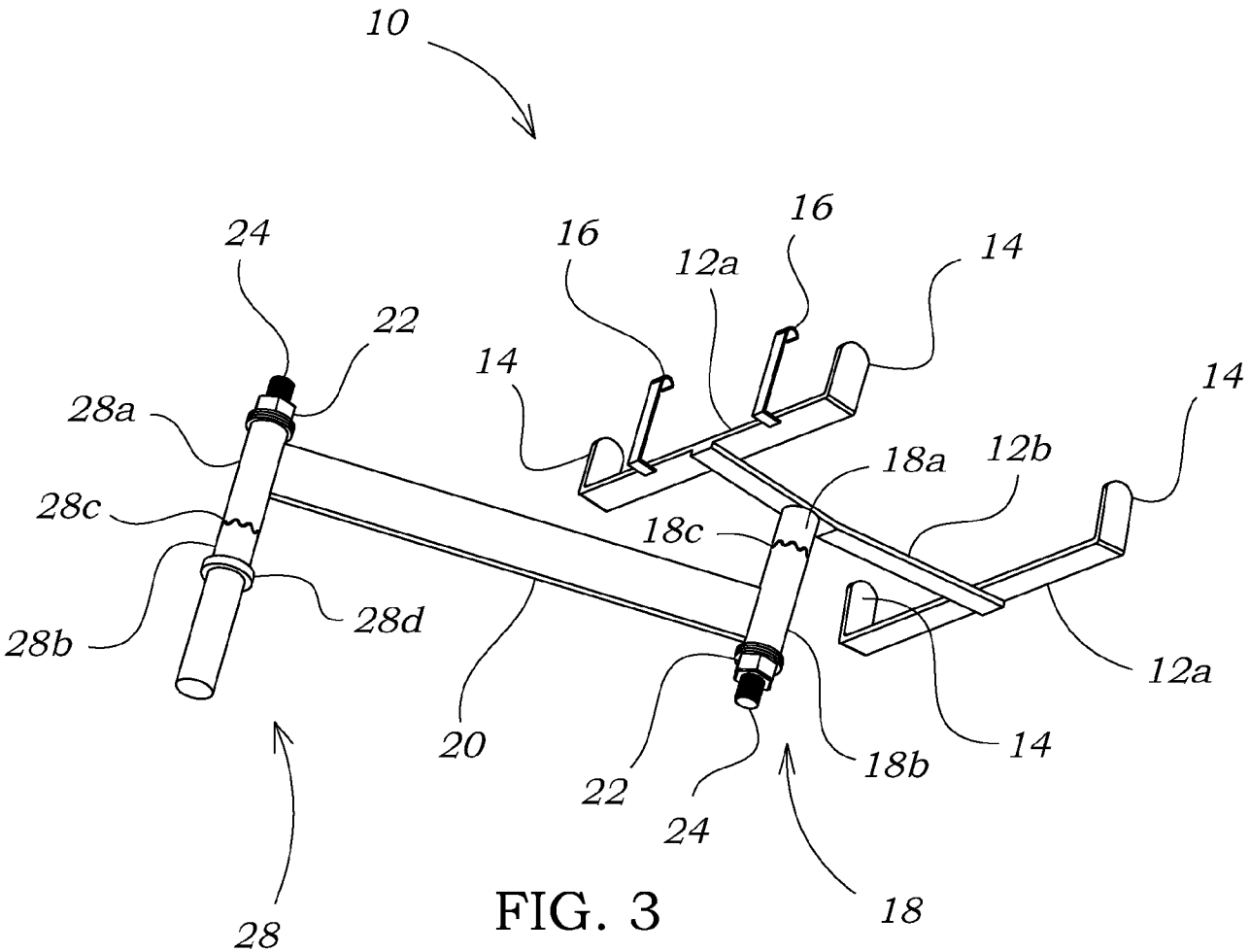
FIG. 3 is a bottom perspective view of one embodiment of the tray.

One embodiment of the tray 10 is shown disengaged from the scaffold 30 in FIGS. 2 and 3. In that embodiment the tray 10 includes two end horizontal supports 12*a* connected to a center horizontal support 12*b* at each end of the center horizontal support 12*b* such that the center horizontal support 12*b* and the two end horizontal supports form and "I" shape. Affixed to the end of each end horizontal support 12*a* is a vertical support 14, such that the embodiment of the tray 10 pictured herein includes four vertical supports 14. The end horizontal supports 12*a* and center horizontal support 12*b* serve to support the majority of the weight of the material resting on the tray 10, and the vertical supports 14 serve to secure the position of the material.

Figure 5:
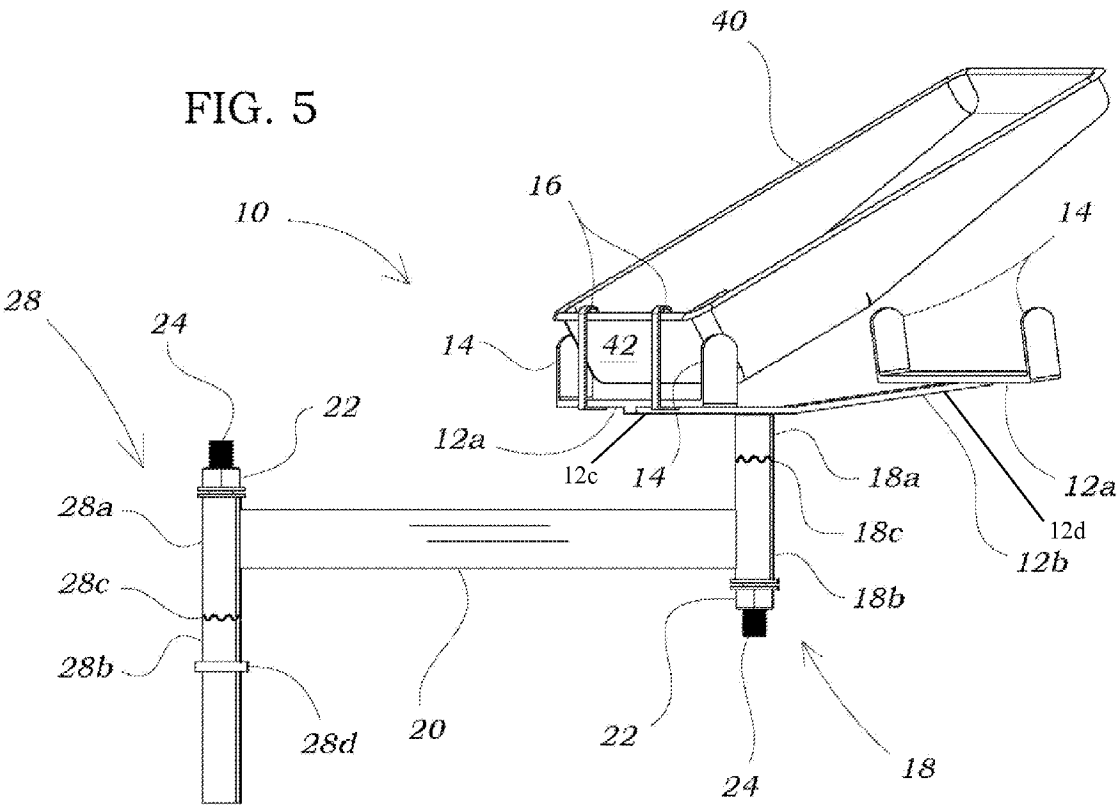
FIG. 5 is a detailed view a paint container partially engaged with one embodiment the tray, such as during removal of the paint container from the tray.

As shown in FIG. 5, the center horizontal support 12*b* may be configured with a center support first portion 12*c* and a center support second portion 12*d*. Also as shown, the center support first portion 12*c* may be configured such that it is substantially horizontal during use, and the center support second portion 12*d* may be configured such that it is angled upward with respect to the center support first portion 12*c*. In the embodiment shown, the angle between the center support first and second portions 12*c*, 12*d* is greater than 90 degrees, although other configurations may be used without limitation. As described below, this angled configuration may be especially useful for engaging a paint container 40.

As previously described, the end horizontal supports 12*a* may be connected to either end of the center horizontal support such that the configuration forms an "I" shape, which is best shown in FIGS. 2-4. Again referring to FIG. 5, the end horizontal support 12*a* connected to the center support first portion 12*c* may be located in a plane that is parallel with respect to the center support first portion 12*c*. In a similar manner, the end horizontal support 12*a* connected to the center support second portion 12*d* may be located in a plane that is parallel with respect to the center support second portion 12*d*. Such a configuration allows a user to securely engage a paint container 40 with the tray 10 without the paint container 40 tipping and/or shifting positions due to inadequate support.

In the embodiment shown in FIGS. 1-5, two retainer hooks 16 are affixed to one of the end horizontal supports 12*a*. The retainer hooks 16 in the embodiment shown in FIGS. 1-5 are fashioned to wrap around the end wall 42 of a paint container 40, which is best shown in FIGS. 4 and 5. The type of paint container 40 shown herein is well known to those skilled in the art and is typically used for painting with a roller. This type of paint container 40 is shown being removed from the tray 10 in FIG. 5.

The exterior surface of the bottom wall 44 of a paint container 40 rests upon the center horizontal support 12*b* and/or the end horizontal supports 12*a*. Accordingly, the center horizontal support 12*b* may be angled as shown in the embodiment pictured herein to better follow the contour of the bottom wall 44 of a paint container 40. The end horizontal supports 12*a*, center horizontal supports 12*b*, vertical supports 14, and retainer hooks 16 may be integrally formed with one another, or the various components thereof may be separately formed and later affixed to another through any method known to those skilled in the art, including but not limited to welding, chemical adhesion, or mechanical connecting structures.

Oriented below the center horizontal support 12 is a tray post 18. As is best shown in FIGS. 2 and 3, the tray post 18 is comprised of a tray post top piece 18*a* and a tray post bottom piece 18*b*, wherein tray post cooperating teeth 18*c* form an interface therebetween. The tray post top piece 18*a* is affixed to the center horizontal support 12*a* and the tray post bottom piece 18*b* is affixed to one end of the arm 20. The tray post top piece 18*a* may be integrally formed with the center horizontal support 12*a*, or separately formed and later affixed thereto. The tray post bottom piece 18*b* may be integrally formed with the arm 20, or separately formed and later affixed thereto. The tray post cooperating teeth 18*c* allow the center horizontal support 12*b* to be rotated with respect to the arm 20, which is explained in further detail below.

On the end of the arm 20 opposite the tray post 18 is the scaffold post 28. The scaffold post 18 is configured in a similar manner to the tray post 28, with a scaffold post top piece 28*a* affixed to the end of the arm 20 (which may be integrally formed therewith or separately formed) and a scaffold bottom piece 28*b*. A set of scaffold post cooperating teeth 28*c* form an interface between the scaffold post top piece 28*a* and bottom piece 28*b* and allow the scaffold post top piece 28*a* to be rotated with respect to the scaffold post bottom piece 28*b*.

In the embodiment pictured herein, a portion of the scaffold post bottom piece 28*b* is formed so that it may be inserted into the end of a scaffold vertical member 32. A scaffold stop 28*d* may be formed in the scaffold post bottom piece 28*b* to limit the distance into the scaffold vertical member 32 that the scaffold post bottom piece 28*b* may protrude.

In both the tray post 18 and the scaffold post 28 in the embodiment pictured herein, a nut 22, bolt 24, and internal spring (not shown) are used to bias the tray post top piece 18*a* and scaffold post top piece 28*a* toward the tray post bottom piece 18*b* and scaffold post bottom piece 28*b*, respectively. This configuration allows the tray post top piece 18*a* and scaffold post top piece 28*a* to be rotated with respect to the tray post bottom piece 18*a* and scaffold post bottom piece 28*b*, respectively. The tray post cooperating teeth 18*c* and scaffold post cooperating teeth 28*c* may be formed such that each successive positioning of the cooperating teeth 18*c*, 28*c* rotates the top piece 18*a*, 28*a* with respect to the bottom piece 18*b*, 28*b* by a specific amount, such as fifteen degrees. The optimal amount by which the top pieces 18*a*, 28*a* rotate with respect to the bottom pieces 18*b*, 28*b* will vary from one application to the next, but it is contemplated that the amount will be between ten and sixty degrees. Accordingly, the cooperation of the tray post 18 and scaffold post 28 allow the user to rotate a paint container 40 engaged with tray 10 independently about two different axes of rotation.

As disclosed, the embodiment pictured in FIGS. 1-5 allows the user to place a paint container 40 in a convenient position. A bolt 24 extends through the tray post 18 and a nut 22 is threaded on the end of the bolt 24. An internal spring (not shown) biases the tray post top piece 18*a* of the to the tray post bottom piece 18*b* so that a predetermined amount of force is required to rotate the tray post top piece 18*a* with respect to the tray post bottom piece 18*b* about the tray post cooperating teeth 18*c*, as explained above. In the same manner the scaffold post top piece 28*a* engages the scaffold bottom piece 28*b* about the scaffold post cooperating teeth 28*c*. The number of notches in the tray post or scaffold post cooperating teeth 18*c*, 28*c* may vary depending on the specific application and preferences of the user.

Figure 6:
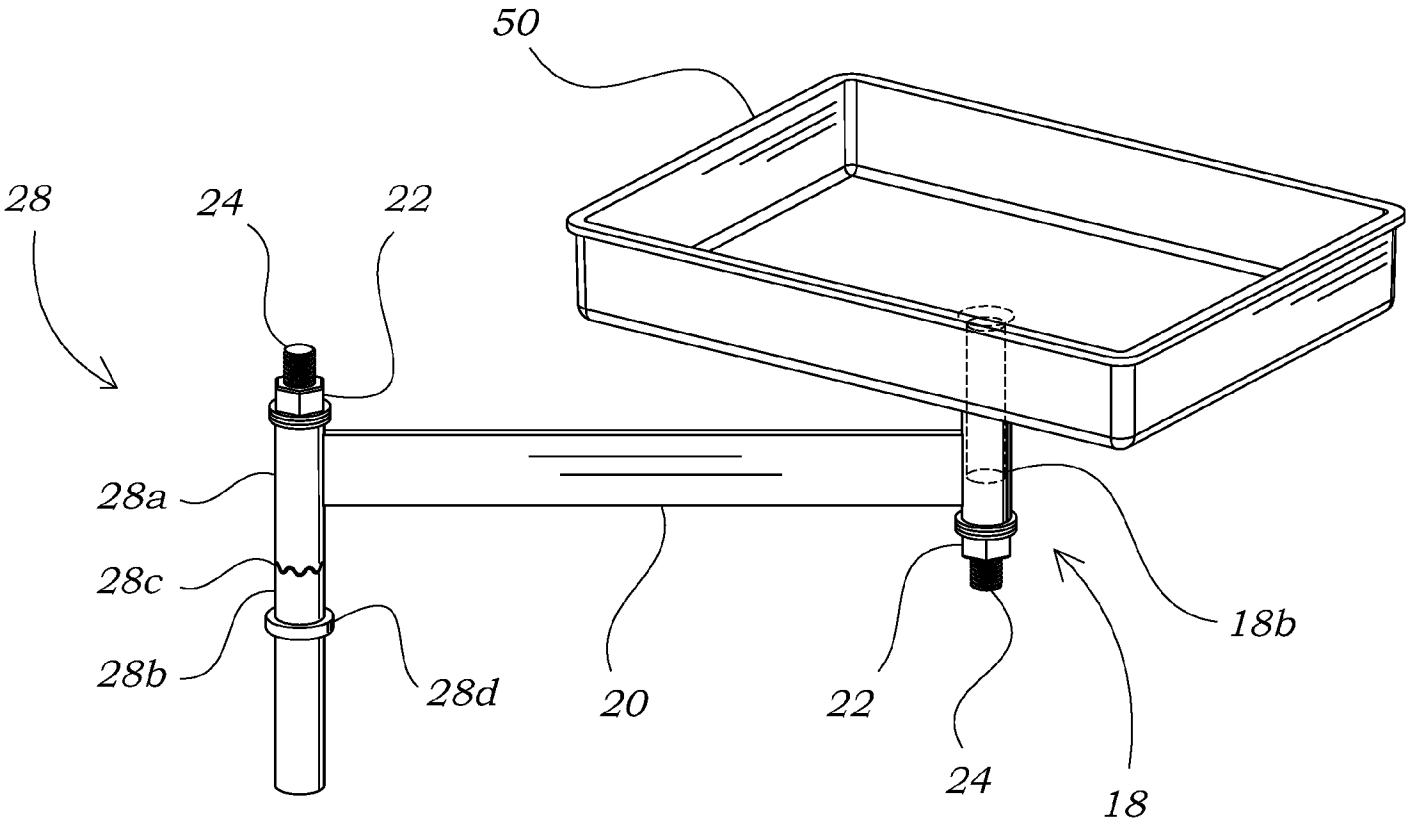
FIG. 6 is a perspective view of another embodiment of the tray utilizing a tub for a support structure.

In the embodiment of the tray shown in FIGS. 1-5, the end horizontal supports 12*a*, center horizontal support 12*b*, and vertical supports 14 cooperate to form one type of support structure for supporting various items. In other embodiments of the tray 10, the support structure may be formed differently. For example, in the embodiment pictured in FIG. 6, the tray 10 is not specifically designed to support a paint container 40. Instead, the tray 10 is fashioned so that the support structure is a tub 50, which may be used to support any item that is within the structural limitations of the tray 10. The tub 50 may hold work pieces, supplies, tools, or other objects needed for a specific task. In this embodiment, the tub 50 is integrally formed with the tray post top piece 18*a*, but those two elements may be separately formed and later affixed to one another. The tub 50 may be constructed of any material known to those skilled in the art that is suitable for the specific application of the tray 10, including but not limited to polymers, metallic alloys, cellulosic material, and/or combinations thereof.

In an embodiment of the tray 10 not pictured herein, the interface between the top pieces 18*a*, 28*a* and bottom pieces 18*b*, 28*b* does not include cooperating teeth 18*c*, 28*c*. For example, if the top pieces 18*a*, 28*a* and bottom pieces 18*b*, 28*b* are constructed of a plastic or polymer material, the interface between them may be a simple interference fit. The tray post 18 and the scaffold post 28 of any single tray 10 may use the same or different interfaces between the top pieces 18*a*, 28*a* and bottom pieces 18*b*, 28*b* thereof depending on the materials of construction.

In embodiments of the tray 10 using a clamp (not shown) to secure the tray 10 to the scaffold 30, a scaffold post 28 affixed to the arm 20 is not required. Instead, the clamp (not shown) may be fashioned to directly engage either a scaffold vertical member 32 or a scaffold horizontal member 34. Additionally, the clamp (not shown) may be configured to allow the arm 20 to rotate about the interface of the clamp (not shown) and the scaffold 30, or the interface of the clamp (not shown) and the arm 20, as is well known to those skilled in the art. If the tray 10 is to be affixed to structures other than scaffolds 30, the clamp (not shown) may be modified by those of ordinary skill in the art so properly engage those structures.

In an embodiment not pictured herein, the tray post 18 and/or scaffold post 28 may be adjustable with respect to elevation. This may be achieved conveniently through the use of a telescoping mechanism similar to that disclosed in U.S. Pat. No. 4,659,125, which is incorporated by reference herein in its entirety. Other structures may be incorporated into the tray 10 to allow the tray post 18 and/or scaffold post 28 to be adjustable with respect to elevation, and any structure known to those skilled in the art may be used without departing from the spirit and scope of the present disclosure.

As mentioned previously, the tray 10 and any of the several elements thereof may be constructed of any suitable material known to those skilled in the art, including metal alloys, aluminum, polymers, wood, resin materials, etc., or a combination thereof that is suitable for the specific application.

It should be noted that the tray 10 is not limited to the specific embodiments pictured and described herein, but is intended to apply to all similar apparatuses for facilitating the support of objects from a scaffold and providing at least two axes of rotation with or without height adjustment therein. Accordingly, modifications and alterations from the described embodiments will occur to those skilled in the art without departure from the spirit and scope of the tray 10.

What is claimed is:

1. A tray comprising:

a. a center support having a center support first portion and a center support second portion, wherein said center support first portion is substantially horizontal, wherein said center support second portion is angled upward with respect to said center support first portion, and wherein said angle between said center support first and second portions is greater than 90 degrees;

b. a first end horizontal support affixed to a distal end of said center support first portion, wherein said first end horizontal support is oriented perpendicular to said center support first portion of said center support, and wherein said first end horizontal support is positioned in a first plane that is parallel with respect to said center support first portion;

c. a first and second vertical support affixed to either end of said first end horizontal support, wherein said first and second vertical supports are oriented perpendicular with respect to said first end horizontal support such that said first and second vertical supports extend out of said first plane;

d. a second end horizontal support affixed to a distal end of said center support second portion, wherein said second end horizontal support is oriented perpendicular to said second portion of said center support, and wherein said second end horizontal support is positioned in a second plane that is parallel with respect to said center support second portion;

e. a third and fourth vertical support affixed to either end of said second end horizontal support, wherein said third and fourth vertical supports are oriented perpendicular with respect to said second end horizontal support such that said third and fourth vertical supports extend out of said second plane;

f. a retainer hook affixed to said first end horizontal support, wherein said retainer hook is oriented perpendicular to said first end horizontal support such that said retainer hook extends out of said first plane;

g. a tray post top piece affixed to said first portion of said center support;

h. an arm, wherein said arm is substantially parallel with respect to said first portion of said center support;

i. a tray post bottom piece affixed to a first end of said arm, wherein said tray post top piece is pivotally affixed to said tray post bottom piece;

j. a scaffold post top piece affixed to a second end of said arm; and k. a scaffold post bottom piece, wherein said scaffold post bottom piece is configured so that a portion thereof may be inserted into a scaffold vertical member, and wherein said scaffold post top piece is pivotally affixed to said scaffold post bottom piece about a substantially vertically oriented axis.

2. The tray according to claim 1 wherein an interface between said tray post top piece and said tray post bottom piece is further defined as being formed through a plurality of cooperating teeth.

3. The tray according to claim 1 wherein an interface between said scaffold post top piece and said scaffold post bottom piece is further defined as being formed through a plurality of cooperating teeth.

4. The tray according to claim 1 wherein said scaffold post bottom piece further comprises a scaffold stop positioned below said scaffold post top piece.

5. The tray according to claim 2 wherein said plurality of cooperating teeth is further defined as including twenty cooperating teeth.

6. The tray according to claim 1 wherein said tray post top piece and said tray post bottom piece are cooperatively engaged with one another via a bolt and a nut.

7. The tray according to claim 1 wherein said scaffold post top piece and said scaffold post bottom piece are cooperatively engaged with one another via a bolt and a nut.

8. The tray according to claim 1 wherein said tray is further defined as being constructed of a synthetic material.

9. The tray according to claim 1 wherein said tray is further defined as being constructed of a metallic material.

* * * * *